US006598272B2

(12) United States Patent
Nire

(10) Patent No.: US 6,598,272 B2
(45) Date of Patent: Jul. 29, 2003

(54) CLASP

(75) Inventor: Takao Nire, Tokyo (JP)

(73) Assignee: Yamato Trading Nire Co., Ltd., Tokyo (JP)

( * ) Notice: Subject to any disclaimer, the term of this patent is extended or adjusted under 35 U.S.C. 154(b) by 0 days.

(21) Appl. No.: 10/028,960

(22) Filed: Dec. 18, 2001

(65) Prior Publication Data

US 2002/0083563 A1 Jul. 4, 2002

(30) Foreign Application Priority Data

Jan. 1, 2001 (JP) ..... 2001-031609

(51) Int. Cl.[7] ..... A44B 21/00
(52) U.S. Cl. ..... 24/303; 24/265 WS
(58) Field of Search ..... 24/303, 265 BC, 24/265 EC, 265 WS, 616, 584.1

(56) References Cited

U.S. PATENT DOCUMENTS 2,615,227 A * 10/1952 Hornik ..... 24/303
3,293,714 A * 12/1966 Shafer ..... 24/303
3,589,341 A * 6/1971 Krebs ..... 119/865
4,231,137 A * 11/1980 Fujimoto ..... 24/303
4,941,236 A * 7/1990 Sherman et al. ..... 24/303
5,664,298 A * 9/1997 Nessar-Ivanovic ..... 24/303
6,292,985 B1 * 9/2001 Grunberger ..... 24/303

* cited by examiner

*Primary Examiner*—Robert J. Sandy
(74) *Attorney, Agent, or Firm*—Ladas & Parry

(57) ABSTRACT

A clasp suitable as button for clothes, buckle for belt or the like adapted to facilitate operation of fastening and unfastening. To provide such clasp suitable as button for clothes, buckle for belt or the like adapted to ensure its reliable fastening. A pair of basic bodies connected to front ends of a pair of swingable arms, respectively, contain therein magnets having opposed poles, respectively. These basic bodies are provided with at least one set of mutually opposed protruberances and notches adapted to come in engagement with each other as the front ends of the swingable arms get nearer toward each other and thereby to prevent the pair of basic bodies coupled to each other under attractive effect of the magnets from moving in horizontal direction as well as from swinging away from each other. Of the pair of basic bodies coupled to each other in vertical direction, the upper interlocking element may be depressed downward to move the front ends of the respective arms and thereby to disengage the protruberance from the notch.

3 Claims, 4 Drawing Sheets

CLASP

BACKGROUND OF THE INVENTION

1. Technical Field of the Invention

The present invention relates to a clasp such as a button for clothes or buckle for belt.

2. Description of the Related Art

While various types of clasp have already been developed and available, it has not always easily to fasten or unfasten these conventional types of clasp.

Problem to be Solved by the Invention

It is a principal object of the present invention to provide a clasp such as a button for clothes or a buckle for belt improved so that the clasp can be easily fastened or unfastened. Another object of the invention is to provide such clasp particularly improved so that the clasp can be reliably fastened.

Measure to Solve the Problem

The object set forth above is achieved, according to the present invention, by a clasp comprising a pair of swingable arms, basic bodies connected to front ends of the respective arms and magnets mounted on the respective basic bodies so that the pair of basic bodies may be detachably coupled to each other under mutual attraction of these magnets.

The basic bodies are formed with at least one set of protruberances and notches opposed to each other, respectively, adapted to come in engagement as the front ends of the swingable arms get near to each other so that the pair of basic bodies once having been coupled together under the mutual attraction of the magnets can neither relatively shift in horizontal direction nor swing away from each other. According to one preferred embodiment of the invention, two sets of protruberances and notches adapted to come in engagement, respectively, are provided on peripheral edges of the basic bodies so as to be oriented orthogonally to longitudinal direction of the arms.

An assembly of the paired basic bodies and the arms present a curved shape as the basic bodies are coupled to each other and the basic bodies connected to the front ends of the arms lie at a level above pivot pins adapted to support the arms in a swingable fashion. According to another preferred embodiment of the invention, the assembly of the paired basic bodies and the arms present a circular arc-like shape as the interlocking element are coupled.

Of the pair of basic bodies coupled to each other in vertical direction, the front ends of the swingable arms are moved downward as the upper interlocking element is depressed downward so that the protruberances and the notches may be disengaged from each other.

According to still another preferred embodiment of the invention, one of the basic bodies connected to the front ends of the arms is formed on its front peripheral edge with a cutout so that the end of the one arm may come in engagement with the cutout of the interlocking element connected to the front end of the other arm and thereby the pair of basic bodies coupled to each other are position-determined with respect to the arms.

From the state in which the front end of the one arm is in engagement with the cutout of the interlocking element connected to the front end of the other arm and the paired basic bodies are coupled to each other, the front end of the one arm is progressively disengaged from the cutout without affecting the positions at which the respective basic bodies are connected to the associated arms.

According to further another preferred embodiment of the invention, of the paired basic bodies coupled to each other in vertical direction, the upper interlocking element has its top surface being flat or gently curved.

The clasp further includes a pair of anchoring means each comprising a ring-like frame surrounding an opening and the arms are pivotally mounted on these anchoring means.

According to still further another preferred embodiment of the invention, the pair of arms are length-dimensioned to be different from each other.

DESCRIPTION OF THE PREFERRED EMBODIMENTS

Figure 1:
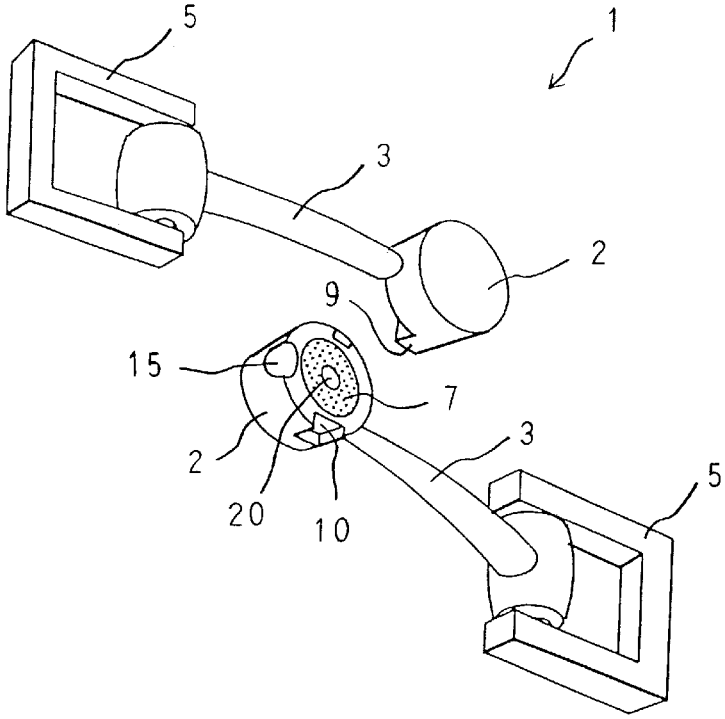
FIG. 1 is a perspective view showing a pair of basic bodies constituting the clasp according to the invention as disengaged from each other.
Figure 2:
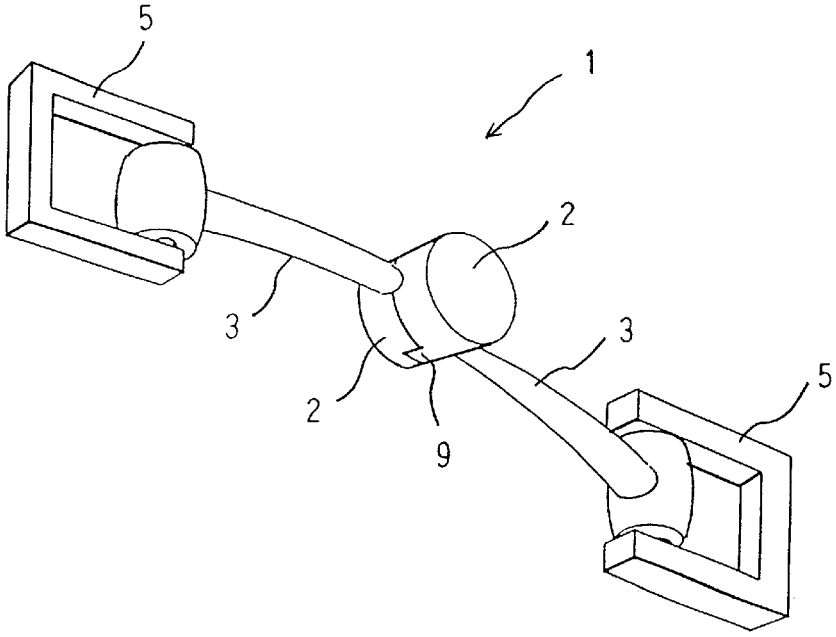
FIG. 2 is a perspective view showing the pair of basic bodies constituting the clasp of FIG. 1 as engaged with each other.
Figure 3:
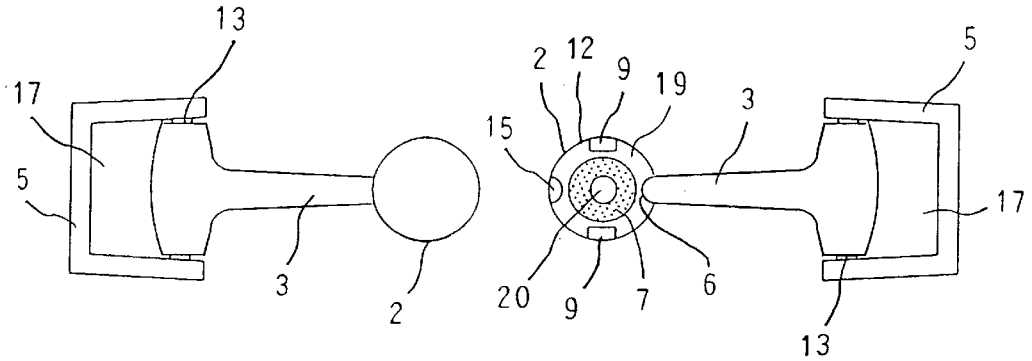
FIG. 3 is a plan view showing the pair of basic bodies constituting the clasp according to the invention as disengaged from each other.
Figure 4:
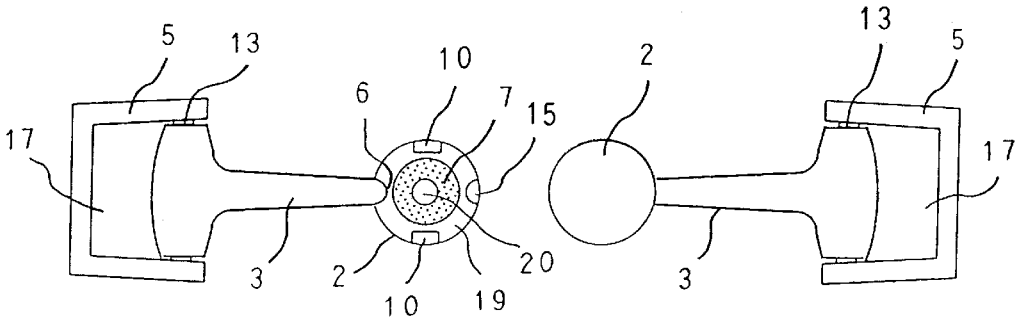
FIG. 4 is a rear view showing the pair of basic bodies constituting the clasp of FIG. 3 as disengaged from each other.
Figure 5:
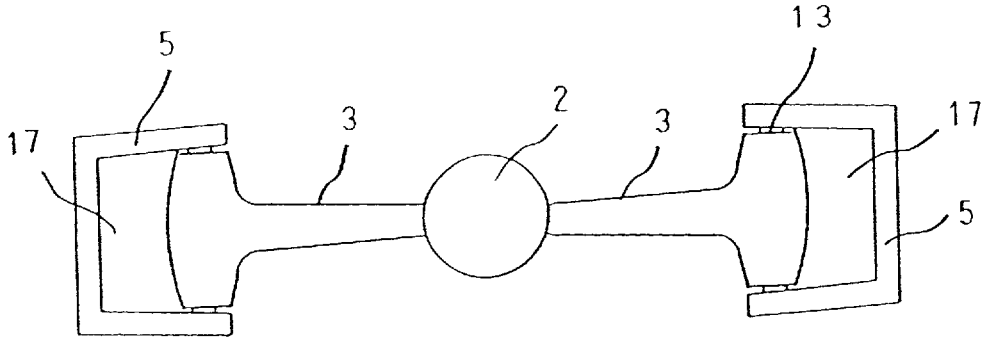
FIG. 5 is a plan view showing the pair of basic bodies constituting the clasp according to the invention as engaged with each other.
Figure 6:
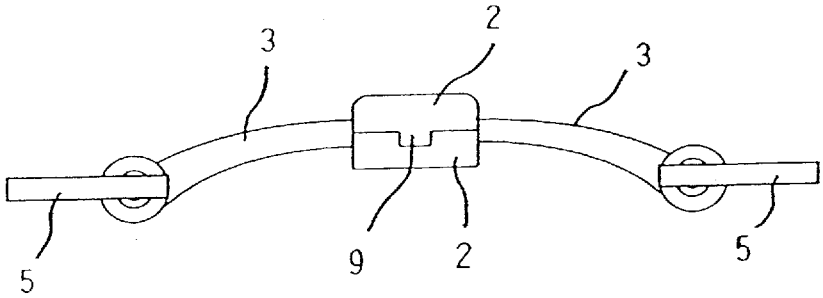
FIG. 6 is a front view showing the pair of basic bodies constituting the clasp of FIG. 5 as engaged with each other.

Details of the clasp according to the present invention will be more fully understood from the description of a typical embodiment of this invention given hereunder in reference with the accompanying drawings. A clasp 1 comprises a pair of basic bodies 2, 2, and arms 3, 3 respectively having front ends connected to the associated basic bodies 2, 2 and rear ends pivotally connected to respective anchoring means 5, 5 wherein the basic bodies 2, 2 contain therein magnets 7, 7, respectively, of opposite poles. With such arrangement, the basic bodies 2, 2 connected the front ends 6, 6 of the respective arms 3, 3 are detachably engaged with each other under a magnetic effect provided by the pair of magnets 7, 7 arranged in opposite polar relationship and thereby adapted to attract each other.

The pair of basic bodies 2, 2 are formed on surfaces thereof opposed to each other with at least one set of interlocking protruberances 9 and notches 10 so that these protruberances 9 and notches 10 may be interlocked as the front ends 6, 6 of the respective arms 3, 3 rotate toward each other. Once the pair of basic bodies 2, 2 have been engaged with each other under the magnetic effect of the magnets 7, 7 in this manner, mutual shift in horizontal direction as well as angular shift of these basic bodies 7, 7 are reliably prevented by interlocking of the protruberance 9 and the notch 10. It should be understood that a pattern in which the front ends of the respective arms move on toward each other is not limited to rotation of the respective arms 3, 3 but the other various patterns are also possible. For example, it is possible for the front ends of the respective arms 3, 3 to move on toward in horizontal direction. Depending on situation, the front ends of the respective arms should move on toward each other at least by rotation thereof toward each other.

While the desired interlocking effect may be accomplished by a single set of the protruberances 9 and the notches 10 (not shown), the preferred embodiment is illustrated to have two sets of these interlocking means 9, 10, each comprising the protruberance 9 and the notch 10 opposed to each other. The positions at which these sets of interlocking means are not specified but these sets of interlocking means 9, 10 are preferably formed on peripheral edges 12 of the respective basic bodies so as to be oriented orthogonally to the longitudinal direction of the respective arms 3, 3.

Figure 7:
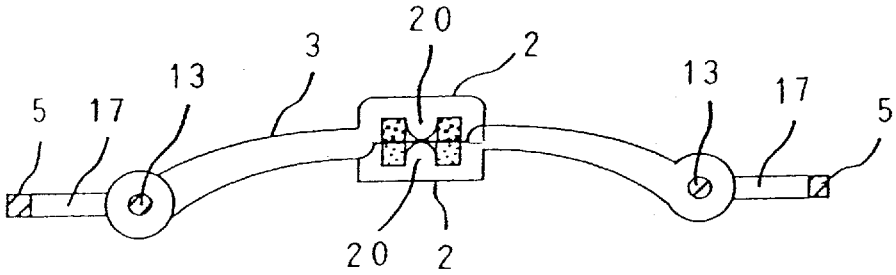
FIG. 7 is a sectional views showing the clasp of FIG. 6.
Figure 8A:
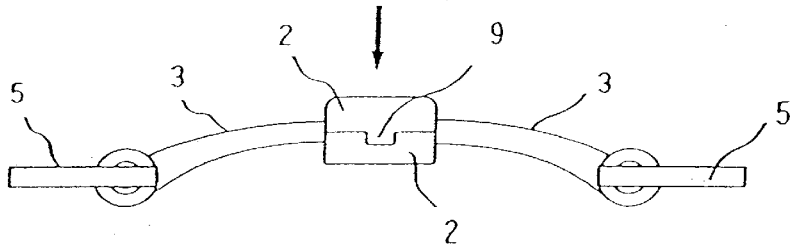
FIGS. 8A–8D depict a front view sequentially illustrating steps of disengaging the pair of basic bodies constituting the clasp according to the invention once having been engaged with each other.
Figure 8B:
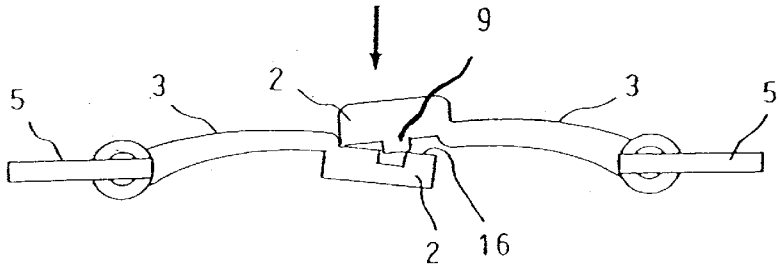
Figure 8C:
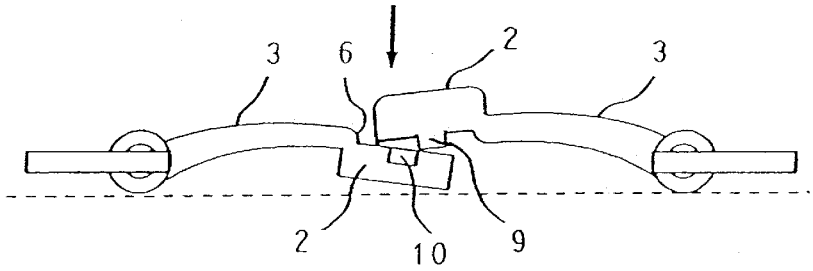
Figure 8D:
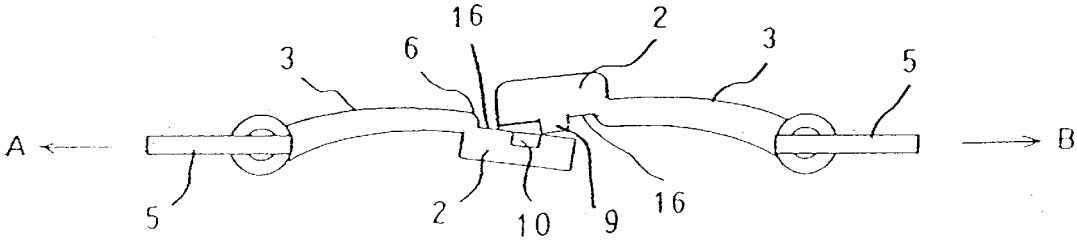

While the pair of basic bodies 2, 2 inclusive of the arms 3, 3 may be arranged so as to present a rectilinear configuration extending in horizontal direction (not shown) as the basic bodies 2, 2 are engaged with each other, it is preferred to arrange such assembly so as to present an appropriately curved configuration with the basic bodies 2, 2 engaged with each other. More specifically, the assembly of the paired basic bodies 2, 2 and the arms 3, 3 having the rear ends connected to the respective anchoring means by means of pivot pins presents a curved configuration, for example, in circular arc as the pair of basic bodies 2, 2 are brought in mutual engagement (See FIG. 7). In this situation, the basic bodies 2, 2 connected to the front ends 6, 6 of the respective arms 3, 3 lie at a level defined above the pivot pins 13 (See FIG. 7). The pair of basic bodies 2, 2 brought in mutual engagement are held by the magnets 7, 7 contained therein and the (two sets of) interlocking means (each comprising the protruberance 9 and the notch 10) to be placed exactly upon each other in horizontal direction. Thus the assembly of the paired basic bodies 2, 2 and the respective arms 3, 3 is held in the shape of circular arc having its apex defined by the basic bodies 2, 2. Particular degree and/or manner of curving may be appropriately selected depending on particular purpose for which the clasp, 1 is used.

The pair of basic bodies 2, 2 placed upon and engaged with each other in vertical direction can be disengaged from each other by depressing the one basic body, for example, with a finger tip downward. Thereupon, the front ends 6, 6 of the swingable arms are moved downward (together with the basic bodies 2, 2 connected to the respective front ends 6, 6) and the interlocking protruberance 9 and notch 10 are disengaged from each other (See FIGS. 8A–8D). Specifically, the assembly of the basic bodies 2, 2 and the associated arms 3, 3 may be depressed downward until the assembly as a hole takes a rectilinear position extending in horizontal direction to generate a gap between the opposed surfaces 16, 16 of the paired basic bodies 2, 2, respectively, which have been in close contact with each other and thereby to separate these basic bodies 2, 2 from each other. Simultaneously, the distal end of the protruberance 9 (the other end of the protruberance 9 as viewed in FIGS. 8A–8D) is moved from the bottom of the notch 10 onto the surface 16 of the other interlocking element and thus disengaged from the notch 10.

Upon release of the engagement between the protruberance 9 and the notch 10 which has prevented the basic bodies 2, 2 from horizontally moving as well as swinging, these basic bodies 2, 2 can be easily separated from each other. If the protruberance 9 and the notch 10 are still in engagement with each other, for example, one of the arms 3, 3 may be swung away from the other arm 3 with a finger tip against the magnetic attraction of the magnets to separate the basic bodies 2, 2 from each other. Also when the protruberance 9 and the notch 10 have already been disengaged from each other, the one arm 3 may be swung from the other arm 3 to separate the basic bodies 2, 2 from each other. In the latter case, swinging (i.e., separation) of the one arm 3 relative to the other arm 3 is relatively easy since the gap is generated between the opposed surfaces of the respective basic bodies 2, 2 which have been in close contact with each other and thereby the magnetic attraction exerted on these basic bodies are somewhat attenuated. It will be obviously understood that the basic bodies 2, 2 can be easily separated from each other merely by pulling one of the arms 3, 3 in longitudinal direction (direction indicated by arrow A or B in FIG. 8D) rather than swinging the arm 3 so far as the protruberance 9 and the notch 10 have already been disengaged from each other.

Each of the basic bodies 2, 2 connected to the front ends 6, 6 of the respective arms further comprises a cutout 15 formed on its front peripheral edge. The front ends 6, 6 of the respective arms are exposed on the surfaces 16 (the opposed surfaces 16 of the paired basic bodies) of the respective basic bodies 2, 2 connected to the associated front ends 6, 6. When the basic bodies 2, 2 come in mutual engagement, the front end 6 of the one arm 3 is engaged with the cutout 15 of the other interlocking element 2. Consequently, the relative position of the paired basic bodies 2, 2 is determined with respect to the respective arms 3, 3 when the paired basic bodies are engaged with each other.

With the paired basic bodies 2, 2 engaged with each other, the front end 6 of the one arm comes in engagement with the cutout 15 of the other interlocking element 2. From this state, the one interlocking element 2 may be depressed downward to disengage the front end of the one arm is gradually from the cutout 15 of the other interlocking element 2 without affecting the positions at which these arms 3 are connected to the associated basic bodies. As has previously been described, the one interlocking element 2 may be depressed downward, for example, with finger tip to generate a gap between the opposed surfaces 16, 16 of the basic bodies 2, 2 and thereby to disengage the protruberance or protruberances 9 and the notch or notches 10 (See FIGS. 8A–8D) and, in the course of this disengagement, the front end 6 of the one arm cooperating with the cutout 15 of the other interlocking element 2 to function as the fulcrum on which these basic bodies swing until the protruberance or protruberances 9 and the notch or notches 10 as well as the front end 6 of the one arm cooperating with the cutout 15 of the other interlocking element 2 to function as the fulcrum are completely out of engagement. However, so long as the protruberance or protruberances 9 and the notch or notches 10 at least partially remain in engagement, there is no possibility that the front end of the arm 3 and the cutout 15 cooperating together to function as the fulcrum might be disengaged from one another. Therefore, the positions in horizontal direction which the basic bodies are connected to the associated arms are not affected by disengagement of the protruberance or protruberances 9 from the notch or notches 10. In other words, the relative positions of the basic bodies and the associated arms are kept unaffected. Once the protruberance or protruberances 9 has or have been disengaged from the notch or notches 10, the basic bodies 2, 2 can be easily separated from each other merely by moving the arms 3, 3 in longitudinal direction (direction indicated by the arrow A or B in FIG. 8D).

The clasp 1 presenting a curved shape (e.g., a circular arc-shape) inclusively of the arms can be used in curved or flat regions of various articles. When the clasp having such curved shape is anchored on the article in its flat region by means of the anchoring means, the basic bodies of such clasp engaged with each other can be easily depressed downward to disengage them from each other and thereby to unfasten the clasp. Even when the clasp is anchored on the article in its curved region, the basic bodies may be depressed downward so that the curved region of the article also is somewhat depressed to unfasten the clasp.

Each of the anchoring means 5, 5 is defined by a rectangular frame surrounding an opening. The shape of these anchoring means 5, 5 is not limited to the rectangle but may be appropriately selected from a group including oval and circular ring etc. To these anchoring means 5, 5, the respective arms 3, 3 are pivotally mounted. The arms 3, 3 are linear and facilitate operation of fastening and unfastening the clasp. While the pair of arms 3, 3 are usually same in length thereof as in the illustrated embodiment, the arms 3, 3 may be different in length thereof (not shown) and the length may be adjusted depending on a particular purpose of using the clasp.

While the surfaces of the paired magnets 7, 7 or the surfaces 16, 16 of the paired basic bodies 2, 2 opposed to each other are usually adapted to come in close contact with each other, the opposed surfaces of the magnets may have a somewhat clearance therebetween (although the magnetic attraction is inevitably somewhat attenuated) Each of these magnets 7, 7 has a doughnut-like shape centrally defining an opening and is fixed to the interlocking element 2 inside its non-magnetic frame 19. The interlocking element 2 is centrally provided with a protuberance 20 adapted to be inserted into the opening of the magnet 7.

Effect of the Invention

The clasp according to the present invention facilitates the button for clothes, buckle for belt or the like to be fastened and unfastened. In addition, this novel clasp ensures, if it is desired, the button for clothes, the buckle for belt or the like to be positioned by fastening it.

Identification of Reference Numerals used in the Drawings

1 clasp
2 basic bodies
3 arms
5 anchoring means
6 front ends of arms
7 magnets
9, 10 dent and notch
15 cutout
17 openings
19 frames
20 protuberance

What is claimed is:

1. A clasp comprising a pair of swingable arms, a pair of basic bodies connected to front ends of the respective arms and magnets mounted on the respective basic bodies so that the pair of basic bodies may be detachably coupled to each other under mutual attraction of these magnets, and further including a pair of anchoring means each comprising a ring-like frame surrounding an opening, wherein the arms are pivotally mounted on these anchoring means.

2. A clasp comprising a pair of swingable arms, a pair of basic bodies connected to front ends of the respective arms an magnets mounted on the respective basic bodies so that the pair of basic bodies may be detachably coupled to each other under mutual attraction of these magnets, wherein said clasp comprises at least one set of protruberances and notches adapted to come in engagement, said at least one set of protruberances and notches being formed on peripheral edges of said basic bodies, wherein an assembly of the paired basic bodies and said arms present a curved shape as said basic bodies are coupled to each other and the basic bodies connected to the front ends of said arms lie at a level above pivot pins adapted to support said arms in a swingable fashion, wherein, from a state in which the front end of one arm is in engagement with a cutout of one basic body in the paired basic bodies connected to the front end of the other arm and the paired basic bodies are coupled to each other, the front end of said one arm is progressively disengaged from said cutout without affecting the positions at which the respective basic bodies are connected to the associated arms, and wherein, of the paired basic bodies coupled to each other in a vertical direction, one basic body in the paired basic bodies has its top surface being flat or gently curved.

3. A clasp comprising a pair of swingable arms, a pair of basic bodies connected to front ends of the respective arms and magnets mounted on the respective basic bodies so that the pair of basic bodies may be detachably coupled to each other under mutual attraction of these magnets, wherein said clasp comprises at least one set of protruberances and notches adapted to come in engagement, said at least one set of protruberances and notches being formed on peripheral edges of said basic bodies, wherein an assembly of the paired basic bodies and said arms present a curved shape as said basic bodies are coupled to each other and the basic bodies connected to the front ends of said arms lie at a level above pivot pins adapted to support said arms in a swingable fashion, and wherein, from a state in which the front end of one arm is in engagement with a cutout of one basic body in the paired basic bodies connected to the front end of the other arm and the paired basic bodies are coupled to each other, the front end of said one arm is progressively disengaged from said cutout without affecting the positions at which the respective basic bodies are connected to the associated arms.

* * * * *